US005695362A

United States Patent [19]

Hillbish et al.

[11] Patent Number: 5,695,362

[45] Date of Patent: Dec. 9, 1997

[54] HYBRID GROUNDED AND STACKED CONNECTOR ASSEMBLY WITH AUDIO JACKS

[75] Inventors: Warren Christian Hillbish, Hummelstown; Jeffrey Byron McClinton, Harrisburg; Keith Scott Koegel, Plainfield, all of Pa.

[73] Assignee: The Whitaker Corporation, Wilmington, Del.

[21] Appl. No.: 722,515

[22] Filed: Sep. 27, 1996

[51] Int. Cl.[6] ..... H01R 13/60

[52] U.S. Cl. ..... 439/541.5; 439/939

[58] Field of Search ..... 439/540.1, 541.5, 439/567, 571, 572, 101, 108, 95, 939

[56] References Cited

U.S. PATENT DOCUMENTS

| | | | |
|---|---|---|---|
| Re. 35,039 | 9/1995 | Masuda et al. | 29/876 |
| D. 377,336 | 1/1997 | Tan et al. | D13/147 |
| 4,673,237 | 6/1987 | Wadsworth | 439/939 |
| 4,702,707 | 10/1987 | Hillbish | 439/80 |
| 4,906,201 | 3/1990 | Young et al. | 439/939 |
| 5,080,609 | 1/1992 | Fabian et al. | 439/540 |
| 5,161,997 | 11/1992 | Defibaugh et al. | 439/939 |
| 5,167,531 | 12/1992 | Broschard, III et al. | 439/540 |
| 5,178,562 | 1/1993 | Ermini | 439/939 |
| 5,195,902 | 3/1993 | Bengal | 439/939 |
| 5,266,053 | 11/1993 | Jamet et al. | 439/939 |
| 5,317,105 | 5/1994 | Weber | 439/939 |
| 5,326,280 | 7/1994 | Briones et al. | 439/939 |
| 5,356,297 | 10/1994 | Haskins | 439/939 |
| 5,407,366 | 4/1995 | Briones et al. | 439/639 |

OTHER PUBLICATIONS

Foxconn Drawing No. 301-0100-465, "Connector, Game/Audio Dual Port D-Sub . . . Audio Jack"; one page; (1995); Hon Hai Precision Ind. Co. Ltd., Taipei, Taiwan, ROC.

*AMP Catalog* 65445, "Amplimite HD-20 Subminiature D Stacked PCB Connectors Series I, Series I and Hybrid Styles", 16 pages; Sep. 1992; AP Incorporated, Harrisburg, PA.

*AMP Catalog* 82208, "Amplimite .050 Series Connectors, Series III"; pp. 24, 74, 75; Dec. 1994; AMP Incorporated, Harrisburg, PA

*Primary Examiner*—Gary F. Paumen
*Assistant Examiner*—Katrina Davis
*Attorney, Agent, or Firm*—Anton P. Ness

[57] ABSTRACT

A connector assembly (10) including at least one audio jack (36,38,40) stacked in a housing (24) with an electrical connector (80). The connector assembly is arranged for surface mounting to a circuit board (12) which is orthogonal to a metal panel (14) having openings (16,18,20,22) which provide access to the audio jacks and to the connector of the connector assembly. A ground clip (62) captured between the audio jacks and the connector assembly housing engages ground terminals (50) of the audio jacks and includes a projecting spring arm (66) which engages the metal panel, thereby providing electrical grounding.

8 Claims, 5 Drawing Sheets

HYBRID GROUNDED AND STACKED CONNECTOR ASSEMBLY WITH AUDIO JACKS

BACKGROUND OF THE INVENTION

This invention relates to electrical connector assemblies and, more particularly, to a connector assembly including an audio jack which is mounted to a circuit board and is accessible through an opening in a metal panel. Specifically, this invention relates to an improved electrical grounding arrangement for such a connector assembly.

Personal computers are becoming more complex and more capable of interfacing outside the confines of the computer case itself. As more functions are added to a computer, the available space on printed circuit boards for the hardware for such functions becomes more limited. Connector assemblies for external interfacing are significant users of such space. It would therefore be desirable to minimize the amount of space required on a printed circuit board for such a connector assembly.

Such a connector assembly is typically mounted on a circuit board for connection to the computer circuitry and is accessible through an opening in the computer casing, usually through a metal panel at the rear of the computer. To conserve space on the circuit board, the connectors can be stacked or otherwise packed closely together. However, this results in the undesirable generation of electrical noise between the circuits defined in the individual connectors. It would therefore be desirable to adequately ground the connectors to minimize electrical noise while at the same time allowing them to be packed relatively closely together.

In one particular application, a computer has a game port connector closely associated with one or more audio jacks. The game port connector is of the type wherein it is known to provide a metal shroud around its mating end to provide grounding. It would be desirable to provide grounding for the audio jacks as well to minimize electrical noise.

SUMMARY OF THE INVENTION

According to the present invention, there is provided a connector assembly for mounting to a circuit board and accessible through at least one opening in a metal panel orthogonal to the circuit board. The assembly comprises an insulative housing having a mounting face for engaging the circuit board, a front wall orthogonal to the mounting face and parallel to the metal panel, an internal cavity communicating with the mounting face and the front wall, and a pair of opposed parallel side walls each extending orthogonally from the mounting face and from the front wall. At least one audio jack is disposed in the cavity of the housing. Each audio jack has an insulative body with a front face, a lower face, a plug receptacle extending from the front face and adapted for receipt of an audio plug through a panel opening, and a plurality of contact terminals extending from the lower face and through the housing mounting face for connection to the circuit board. One of the contact terminals of the audio jack is a ground terminal and has a projection extending outwardly from and exposed at the front face of the audio jack. A conductive ground clip extends between the housing side walls and is captured between the housing front wall and the audio jack front face, the ground clip engaging the audio jack ground terminal projection. The housing front wall is formed with an aperture through which the audio jack plug receptacle is accessible by a mating audio plug, the aperture also exposing a portion of the ground clip. The ground clip exposed portion includes means extending through the aperture for engaging the metal panel when the connector assembly is mounted to the circuit board and assembled to the metal panel.

In accordance with an aspect of this invention, the ground clip comprises a piece of sheet metal formed into a U-shape when viewed in a plane parallel to the housing side walls. The ground clip exposed portion comprises a bent tab formed from the sheet metal along a first side of the U-shape which extends through the housing front wall aperture.

In accordance with another aspect of this invention, the ground clip is further formed with an opening through the side of the U-shape opposite the first side. The opening is arranged to receive the projection of the audio jack ground terminal.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
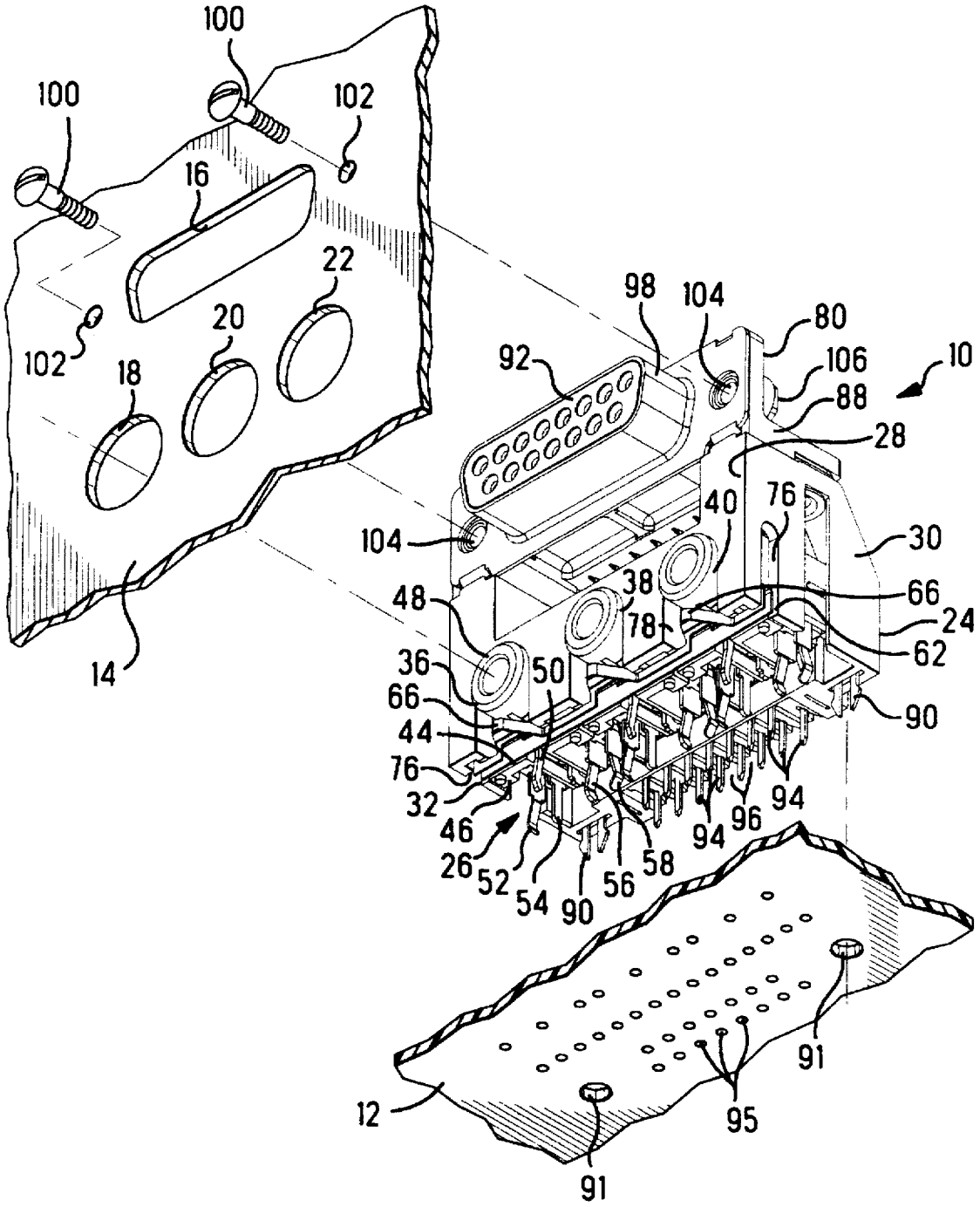
FIG. 1 is a front, bottom and right side isometric view of a connector assembly constructed in accordance with the principles of this invention, showing portions of a circuit board and the metal panel of a computer.

Referring to the drawings, shown therein is a connector assembly, designated generally by the reference numeral 10, and constructed in accordance with the principles of this invention; for mounting on the circuit board 12. In the illustrative embodiment, the circuit board 12 is within a piece of electronic equipment, such as a personal computer, the outer case of which includes a metal panel 14 which is orthogonal to the circuit board 12. The panel 14 is formed with a plurality of openings 16,18,20,22 through which the connector assembly 10 is accessible. Accordingly, the personal computer (or other electronic equipment) may interface through the connector assembly 10 with various pieces of external equipment, which in general is well known in the art.

The connector assembly 10 includes an insulative housing 24 which has a mounting face 26 adapted for engaging the circuit board 12 and a front wall 28 which is orthogonal to the mounting face 26 and parallel to the panel 14. A pair of opposed parallel side walls 30,32 each extends orthogonally from the mounting face 26 and from the front wall 28. Accordingly, there is defined an internal cavity 34 of the housing 24 which is flanked by the mounting face 26, the front wall 28 and the side walls 30,32. As will be clear from the following discussion, the cavity 34 communicates with the mounting face 26 and the front wall 28.

Figure 4:
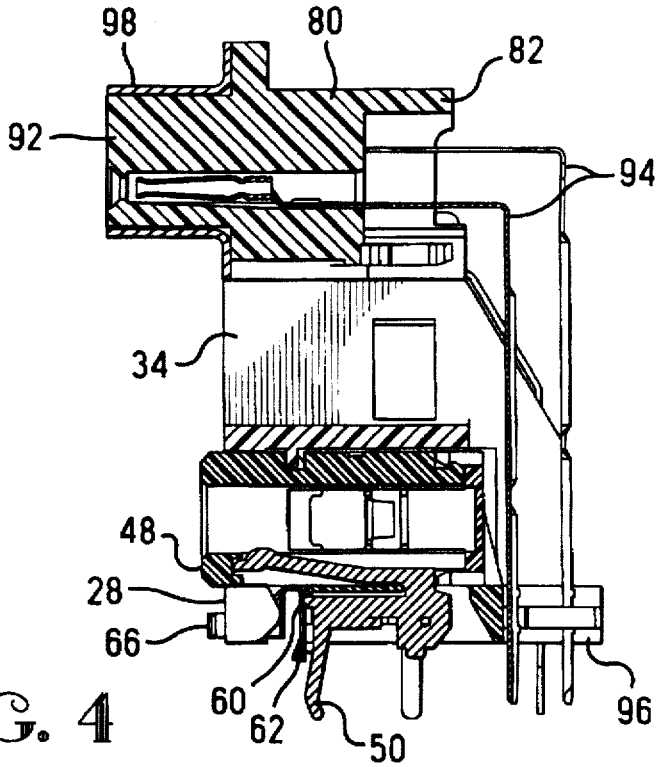
FIG. 4 is a cross sectional view taken along the line 4—4 of FIG. 3.
Figure 5:
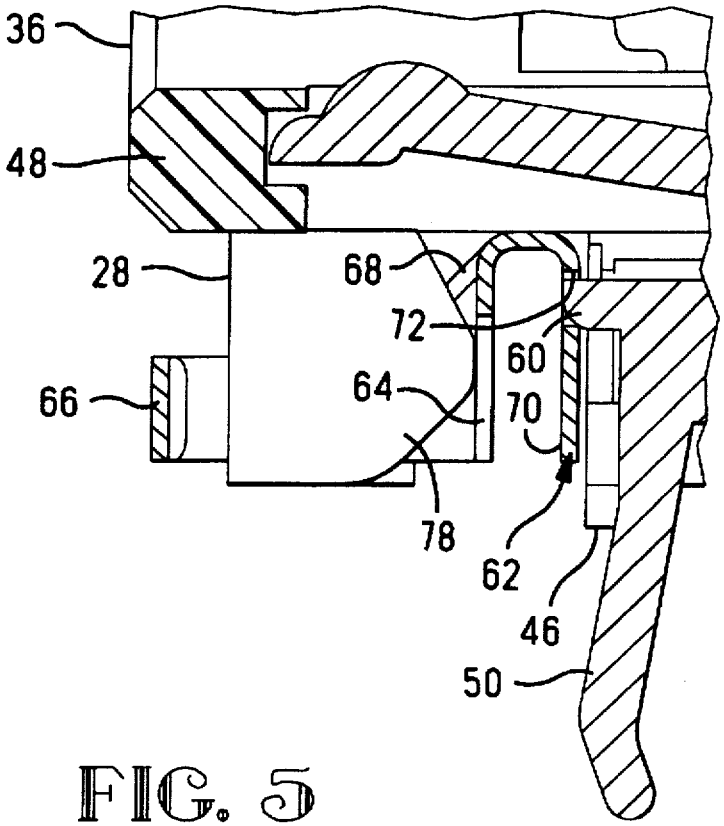
FIG. 5 is an enlarged cross sectional view taken along the line 4—4 in FIG. 3, showing the connection of the ground clip to the audio jack ground terminal.
Figure 9:
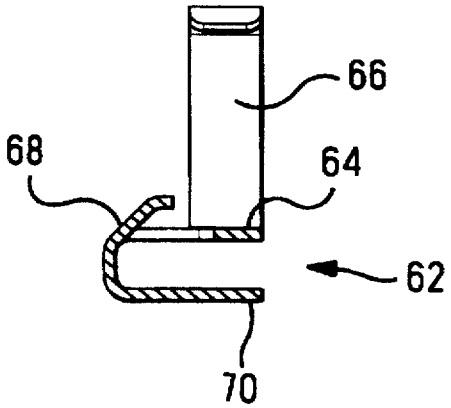
FIG. 9 is a cross sectional view taken along the line 9—9 of FIG. 8.
Figure 6:
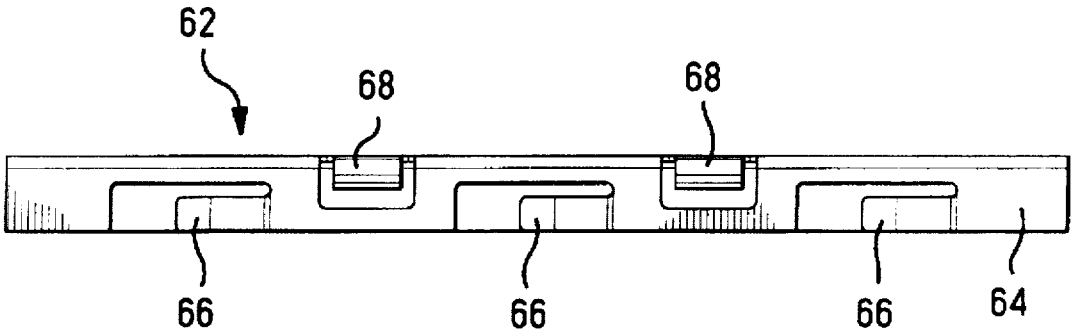
FIG. 6 is a front elevational view of the inventive ground clip.
Figure 7:
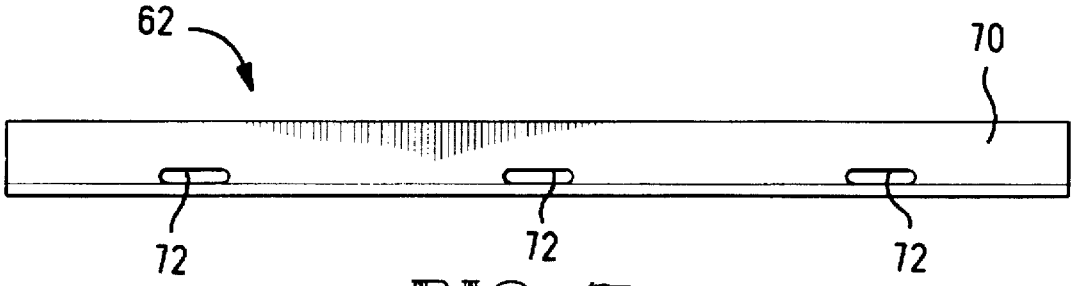
FIG. 7 is a rear elevational view of the inventive ground clip.
Figure 8:
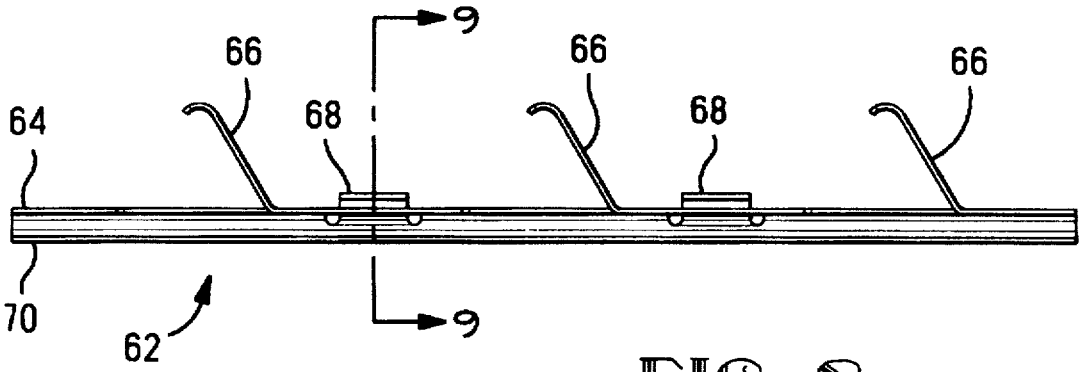
FIG. 8 is a bottom plan view of the inventive ground clip.

As shown, three laterally aligned audio jacks 36,38,40 are disposed in the cavity 34. The jacks 36,38,40 are identical, so only the jack 36 will be described. The jack 36 includes an insulative body 42 having a front face 44, a lower face 46 and a plug receptacle 48 extending from the front face 42. As is conventional, the plug receptacle 48 is adapted for receipt of an audio plug. When mounted to the circuit board 12, the plug receptacle 48 of each of the audio jacks 36,38,40 is accessible through a respective one of the openings 18,20,22 of the panel 14. The audio jack 36 further includes a plurality of contact terminals 50,52,54,56,58 extending from the lower face 46 and through the housing mounting face 26 for connection to the circuit board 12 in a conventional manner. Such audio jacks may be, for example, of the type disclosed in U.S. Pat. No. Re. 35,039. Optionally, in view of the close spacing of audio jacks 36,38,40 in the present assembly 10, it may be desired for contact terminals 56,58 of each jack to be of a straight or inwardly bent design, to maximize spacing from the contact terminals of adjacent audio jacks and minimize the possibility of solder bridging therebetween on the circuit board and resultant short circuits, due to such close spacing in assembly 10. The terminal 50 is a ground terminal and has a projection 60 which extends outwardly from, and is exposed at, the front face 44, as best shown in FIGS. 4 and 5.

According to this invention, a conductive ground clip 62 is provided. The ground clip 62 extends between the side walls 30,32 of the housing 24 and is captured between the housing front wall 28 and the audio jack front face 44. As will be described in full detail hereinafter, the ground clip 62 engages the audio jack ground terminal 50. As best shown in FIGS. 6–9, the ground clip 62 is a piece of sheet metal formed into a U-shape when viewed in a plane parallel to the housing side walls 30,32. Along a first side 64 of the U-shape, the ground clip 62 has an L-shaped cut so that a tab 66 is bent forwardly away from the side 64 to function as a spring arm. Preferably, there are three such tabs 66, each corresponding to a respective one of the audio jacks 36,38, 40. In addition, the side 64 of the ground clip 62 is cut away and bent to form a pair of interfering barbs 68. Further, the opposite side 70 of the ground clip 62 is formed with three openings 72, each associated with a respective one of the jacks 36, 38, 40. Each of the openings 72 is arranged to receive a respective projection 60 of a respective ground terminal 50, as best shown in FIG. 5.

The housing front wall 28 is formed with three arched openings 74 through which the audio jack plug receptacles 48 and the tabs 66 of the ground clip 62 are accessible. In particular, as best shown in FIGS. 4 and 5, the plug receptacles 48 and the tabs 66 extend through respective ones of the openings 74 forwardly beyond the front wall 28 of the housing 24 so that the plug receptacles 48 are within the respective ones of the openings 18,20,22 of the panel 14 and the tab 66 contacts the inner surface of the panel 14.

During assembly, the audio jacks 36, 38, 40 are inserted into the cavity 34 of the housing 24 through an open region of the mounting face 26. The arched openings 74 are open to the mounting face 26 so as to receive the outwardly extending audio jack plug receptacles 48. The outer surfaces of the audio jacks 36,38,40 and the inner surface of the housing 24 are formed with interfering parts (not shown), as is conventional, so that the audio jacks 36,38,40 may be snap fit into the housing 24. The ground clip 62 is then inserted between the front faces 44 of the audio jacks 36,38,40 and the inner surface of the front wall 28 of the housing 24. The openings 74 receive the spring arms 66. Such insertion is with the open side of the U-shape of the ground clip 62 toward the mounting face 26 of the housing 24, as is clear from the drawings. The side walls 30,32 of the housing 24 are formed with elongated slots 76 open to the mounting face 26 to aid in insertion of the ground clip 62. As best shown in FIG. 5, the ground clip 62 is inserted until its closed end abuts the plug receptacles 48. At that time, the projections 60 of the ground terminals 50 snap into respective openings 72 of the ground clip 62 and the barbs 68 snap outwardly past the interfering projections 78 on the rear surface of the front wall 28 between the openings 74. Therefore, once installed, the ground clip 62 is not easily removed.

The connector assembly 10 further includes an electrical connector 80 mounted to the top of the housing 24. Illustratively, the connector 80 may be used as a game port connector for a computer and may comprise an AMPLIMITE 15-position connector manufactured by AMP Incorporated of Harrisburg, Pa. The connector 80 includes an insulating housing 82 supported on the upper surface 84 of the housing 24 and secured thereto by rivets 86 extending through aligned openings in flanges 88 of the housing 82 and openings in the housing 24. Further, captured between the flanges 88 and the upper surface 84 are board locks 90 which are snap fit through suitable openings 91 in the circuit board 12.

Figure 2:
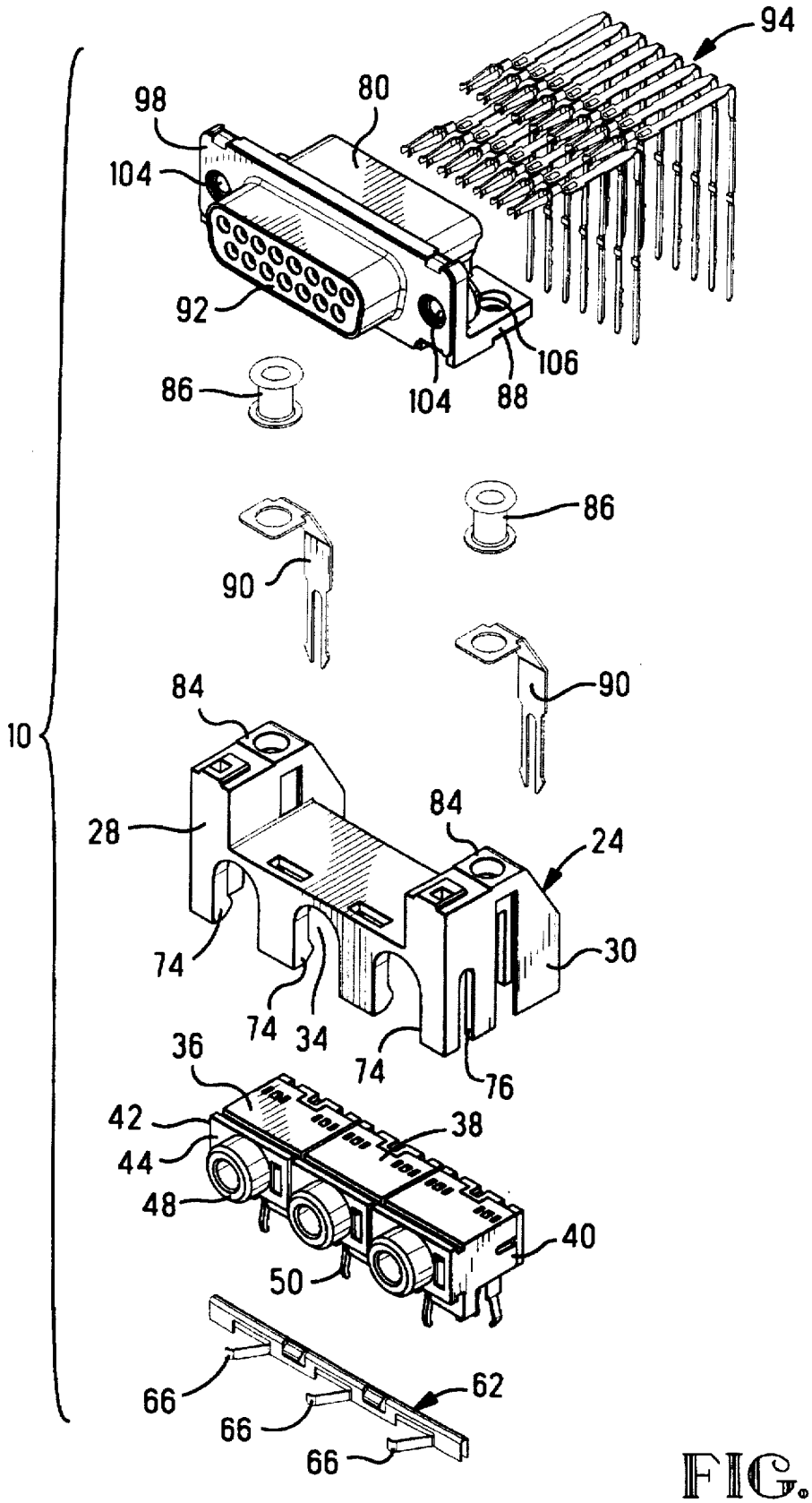
FIG. 2 is an exploded isometric view of the connector assembly of FIG. 1.
Figure 3:
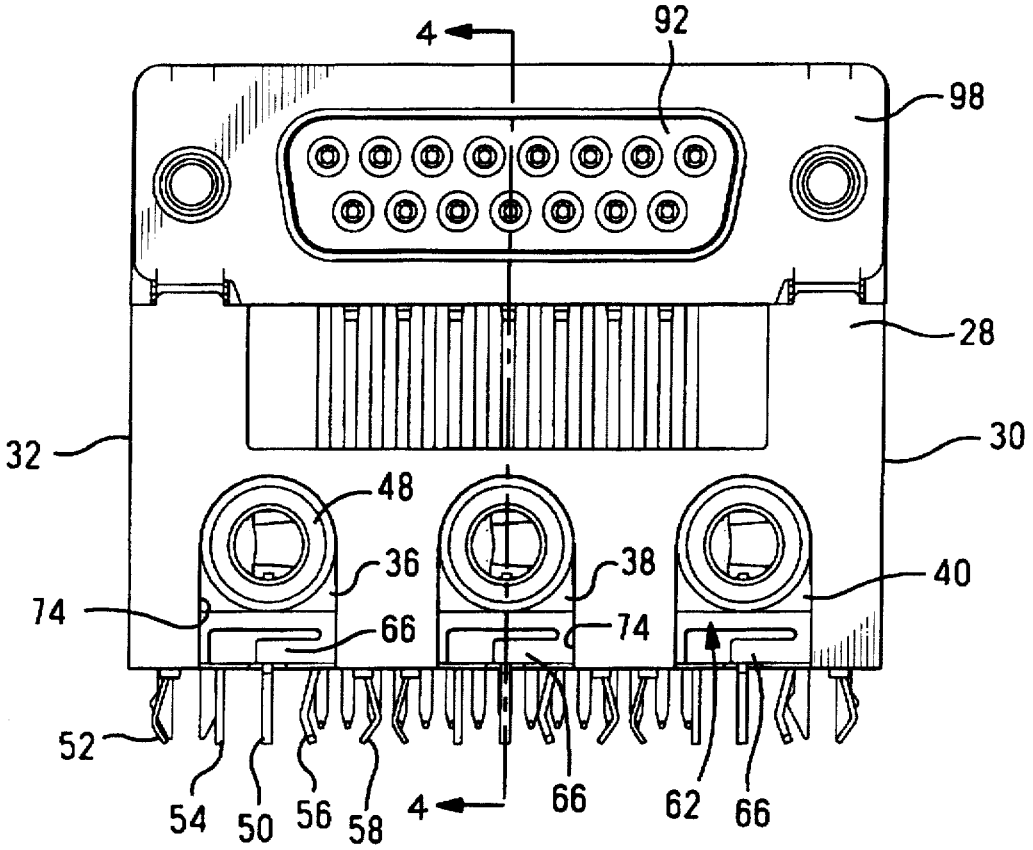
FIG. 3 is a front elevational view of the connector assembly of FIG. 1.

The housing 82 of the connector 80 has a forward mating end 92 which extends beyond the front wall 28 of the housing 24 and through the opening 16 of the panel 14 for engagement with a complementary mating connector, as is conventional. Within the connector housing 82, and exposed at the mating end 92, are a plurality of contacts 94 which are held in a defined array for frictional engagement with respective contacts of the mating connector. Within the connector housing 82, these contacts 94 extend parallel to the circuit board 12 and are bent at right angles outside the housing 82, as best shown in FIGS. 2 and 4, for connection to the circuit board 12 through the openings 95. The housing 24 of the connector assembly 10 is further formed with a plurality of spacer elements 96 at the mounting face 26 and between the side walls 30,32. These spacer elements 96 include slots for holding the contacts 94 in a fixed array corresponding to the defined array at the mating end 92, as is clear from FIG. 1. The connector 80 further includes a metal shroud 98 surrounding the mating end 92 and covering the front face of the housing 82. When the connector assembly 10 is installed, the metal shroud 98 engages the rear surface of the metal panel 14. Further, the screws 100 are inserted through respective openings 102 in the panel 14 and through respective openings 104 in the shroud 98 and the housing 82 and are secured by nuts 106 or other suitable means mounted to the back of the housing 82 to further secure the connector assembly 10 and clamp the shroud 98 to the panel 14.

While the connector assembly 10 has been disclosed with the audio jacks 36,38,40 separate from the housing 24, it is contemplated that this invention may be practiced with the audio jack bodies 42 and the housing 24 formed as a single unitary piece.

Accordingly, there has been disclosed an improved electrical connector assembly including stacked connectors with grounded audio jacks. While a preferred embodiment of this invention has been disclosed herein, it is understood that various modifications and adaptations to the disclosed embodiment are possible, and it is intended that this invention be limited only by the scope of the appended claims.

What is claimed is:

1. A connector assembly (10) for mounting to a circuit board (12) and accessible through at least one opening (18,20,22) in a metal panel (14) orthogonal to said circuit board, the assembly comprising:

an insulative housing (24) having a mounting face (26) for engaging the circuit board, a front wall (28) orthogonal to said mounting face and parallel to said metal panel, an internal cavity (34) communicating with said mounting face and said front wall, and a pair of opposed parallel side walls (30,32) each extending orthogonally from said mounting face and from said front wall;

at least one audio jack (36,38,40) disposed in said cavity, each said audio jack having an insulative body (42) with a front face (44), a lower face (46), a plug receptacle (48) extending from said front face and adapted for receipt of an audio plug through said at least one panel opening, and a plurality of contact terminals (50,52,54,56,58) extending from said lower face and through said housing mounting face for connection to said circuit board, wherein one of said contact terminals is a ground terminal (50) and has a projection (60) extending outwardly from and exposed at said front face; and a conductive ground clip (62) extending between said housing side walls and captured between said housing front wall and said audio jack front face, said ground clip engaging said audio jack ground terminal projection;

wherein said housing front wall is formed with an aperture (74) through which said audio jack plug receptacle is accessible, said aperture also exposing a portion of said ground clip, and said ground clip exposed portion includes means (66) extending through said aperture for engaging said metal panel when said connector assembly is mounted to said circuit board.

2. The assembly according to claim 1 wherein:

there are a plurality of said audio jacks disposed in said cavity and arrayed in lateral alignment between said housing side walls;

said housing front wall is formed with a plurality of said apertures each associated with a respective one of said plurality of audio jacks; and said ground clip engages the ground terminal projection of each of said plurality of audio jacks.

3. The assembly according to claim 1 wherein said ground clip comprises a piece of sheet metal formed into a U-shape when viewed in a plane parallel to said housing side walls and said ground clip exposed portion comprises a bent tab formed from said sheet metal along a first side of said U-shape and extending through said housing front wall aperture.

4. The assembly according to claim 3 wherein said ground clip is further formed with an opening (72) through the side of said U-shape opposite said first side and arranged to receive the projection of said audio jack ground terminal.

5. The assembly according to claim 3 wherein said ground clip first side is formed with at least one outwardly extending interfering barb (68) and said housing front wall is formed with at least one inwardly extending interfering projection (78), wherein said interfering barb and said interfering projection are positioned and oriented so that when said ground clip is installed between said audio jack front face and said housing front wall said interfering barb passes said interfering projection to thereafter interfere with the removal of said ground clip.

6. The assembly according to claim 1 further comprising:

an electrical connector (80) adapted for surface mounting to said circuit board and including:

an insulating housing (82) mounted to said assembly housing above and spaced from said audio jack, said connector housing having a forward mating end (92) extending beyond said assembly housing front wall for engagement with a complementary mating connector;

a plurality of contacts (94) disposed in said connector housing and exposed at said forward mating end in a defined array for frictional engagement with respective contacts of said mating connector; and a metal shroud (98) surrounding said forward mating end for shielding said plurality of contacts; and means (100,106) for electrically connecting said metal shroud with said metal panel; and wherein said metal panel is formed with a further opening (16) adapted to enable said connector forward mating end to extend therethrough.

7. The assembly according to claim 6 wherein said plurality of connector contacts extend out of said connector housing and toward said circuit board and said assembly housing includes a plurality of spacer elements (96) between said assembly housing side walls and adapted to hold said plurality of connector contacts in a fixed array corresponding to said defined array.

8. A connector assembly (10) for mounting to a circuit board (12) and accessible through at least one opening (18,20,22) in a metal panel (14) orthogonal to said circuit board, the assembly comprising:

an insulative housing (24) having a mounting face (26) for engaging the circuit board, a front wall (28) orthogonal to said mounting face and parallel to said metal panel, and a pair of opposed parallel side walls (30,32) each extending orthogonally from said mounting face and from said front wall;

at least one audio jack (36,38,40) disposed in said housing, each said audio jack having an insulative body (42) with a front face (44) parallel to and spaced from said housing front wall, a lower face (46), a plug receptacle (48) extending from said front face beyond said housing front wall and adapted for receipt of an audio plug through said at least one panel opening, and a plurality of contact terminals (50,52,54,56,58) extending through said audio jack lower face and said housing mounting face for connection to said circuit board, wherein one of said contact terminals is a ground terminal (50) and has a projection (60) extending outwardly from and exposed at said audio jack front face; and a conductive ground clip (62) extending between said housing side walls and captured between said housing front wall and said audio jack front face, said ground clip engaging said audio jack ground terminal projection;

wherein said housing front wall is formed with an aperture (74) exposing a portion of said ground clip, and said ground clip exposed portion includes means (66) extending through said aperture for engaging said metal panel when said connector assembly is mounted to said circuit board.

* * * * *